US008016057B2

(12) United States Patent
Deng et al.

(10) Patent No.: US 8,016,057 B2
(45) Date of Patent: Sep. 13, 2011

(54) EROSION RESISTANT SUBTERRANEAN DRILL BITS HAVING INFILTRATED METAL MATRIX BODIES

(75) Inventors: Xin Deng, Rogers, AR (US); Jonathan W. Bitler, Fayetteville, AR (US)

(73) Assignee: Kennametal Inc., Latrobe, PA (US)

( * ) Notice: Subject to any disclaimer, the term of this patent is extended or adjusted under 35 U.S.C. 154(b) by 298 days.

(21) Appl. No.: 12/488,162

(22) Filed: Jun. 19, 2009

(65) Prior Publication Data

US 2010/0320004 A1 Dec. 23, 2010

(51) Int. Cl.
*B22F 1/00* (2006.01)
*E21B 10/46* (2006.01)

(52) U.S. Cl. ..... 175/425; 175/327; 175/435; 75/300; 419/18

(58) Field of Classification Search ..... 175/374, 175/425; 75/240, 252, 236; 76/108.2, 108.4; 419/18
See application file for complete search history.

(56) References Cited

U.S. PATENT DOCUMENTS

| | | | | |
|---|---|---|---|---|
| 3,523,569 | A * | 8/1970 | Quaas | 164/97 |
| 4,834,963 | A | 5/1989 | Terry et al. | |
| 5,589,268 | A | 12/1996 | Kelley et al. | |
| 5,662,183 | A | 9/1997 | Fang | |
| 5,733,649 | A | 3/1998 | Kelley et al. | |
| 5,733,664 | A | 3/1998 | Kelley et al. | |
| 6,287,360 | B1 | 9/2001 | Kembaiyan et al. | |
| 6,663,688 | B2 | 12/2003 | Findeisen et al. | |
| 6,682,580 | B2 | 1/2004 | Findeisen et al. | |
| 6,984,454 | B2 | 1/2006 | Majagi | |
| 7,250,069 | B2 | 7/2007 | Kembaiyan et al. | |
| 7,350,599 | B2 | 4/2008 | Lockwood et al. | |
| 7,398,840 | B2 | 7/2008 | Ladi et al. | |
| 7,475,743 | B2 | 1/2009 | Liang et al. | |
| 7,510,034 | B2 * | 3/2009 | Curry et al. | 175/425 |
| 7,661,491 | B2 * | 2/2010 | Kembaiyan et al. | 175/425 |
| 2004/0245024 | A1 | 12/2004 | Kembaiyan | |
| 2007/0056776 | A1 | 3/2007 | Overstreet | |
| 2007/0175669 | A1 * | 8/2007 | Liang et al. | 175/374 |
| 2007/0240910 | A1 | 10/2007 | Kembaiyan et al. | |
| 2007/0277646 | A1 | 12/2007 | Terry et al. | |
| 2008/0017421 | A1 | 1/2008 | Lockwood | |
| 2008/0029310 | A1 | 2/2008 | Stevens et al. | |
| 2008/0282618 | A1 | 11/2008 | Lockwood | |
| 2008/0289880 | A1 | 11/2008 | Majagi et al. | |
| 2009/0260482 | A1 * | 10/2009 | Curry et al. | 75/240 |
| 2010/0206639 | A1 * | 8/2010 | Lockwood | 175/374 |

FOREIGN PATENT DOCUMENTS

EP 0198627 A1 10/1986

OTHER PUBLICATIONS

WIPO, PCT Written Opinion of ISA, Jan. 13, 2011.
WIPO, PCT International Search Report, Jan. 13, 2011.

* cited by examiner

*Primary Examiner* — Kenneth L Thompson
*Assistant Examiner* — Ronald Runyan
(74) *Attorney, Agent, or Firm* — Matthew W. Gordon

(57) ABSTRACT

Subterranean drill bits having good erosion resistance, strength, toughness, and thermal stability are disclosed. The drill bits comprise a bit body carrying at least one cutting element and having an infiltrated metal matrix. The infiltrated metal matrix comprises a matrix powder composition bound together by an infiltrant. The matrix powder mixture includes cast tungsten carbide powder having a particle size of −30 (600 micron) +140 mesh (106 micron), a second component powder consisting of one or more other types of tungsten carbide particles, and a metal powder.

20 Claims, 4 Drawing Sheets

EROSION RESISTANT SUBTERRANEAN DRILL BITS HAVING INFILTRATED METAL MATRIX BODIES

FIELD OF INVENTION

The present invention relates to subterranean drill bits. More specifically, the present invention relates to subterranean drill bits comprising at least one cutting element and an infiltrated metal matrix.

BACKGROUND OF THE INVENTION

It is well-known to use in subterranean applications such as mining and drilling drill bits, e.g., for gas and oil drilling, having bit bodies or portions thereof which comprise an infiltrated metal matrix. Such bit bodies typically comprise one or more cutting elements, such as polycrystalline diamond cutting inserts, embedded in or otherwise carried by the infiltrated metal matrix. The bit bodies are typically formed by positioning the cutting elements within a graphite mold, filling the mold with a matrix powder mixture, and then infiltrating the matrix powder mixture with an infiltrant metal.

The following patents and published patent applications pertain to or disclose an infiltrated matrix powder useful for forming subterranean drill bit bodies: U.S. Pat. No. 6,984,454 B2 to Majagi, U.S. Pat. No. 5,589,268 to Kelley et al., U.S. Pat. No. 5,733,649 to Kelley et al., U.S. Pat. No. 5,733,664 to Kelley et al., U.S. Patent Application Publication No. 2008/0289880 A1 of Majagi et al., U.S. Patent Application Publication No. 2007/0277646 A1 of Terry et al., all of which are assigned to the assignee of the present patent application. The following patents and published applications also pertain to or disclose an infiltrant matrix powder for bit bodies: U.S. Pat. No. 7,475,743 B2 to Liang et al., U.S. Pat. No. 7,398,840 B2 to Ladi et al., U.S. Pat. No. 7,350,599 B2 to Lockwood et al., U.S. Pat. No. 7,250,069 B2 to Kembaiyan et al., U.S. Pat. No. 6,682,580 to Findeisen et al., U.S. Pat. No. 6,287,360 B1 to Kembaiyan et al., U.S. Pat. No. 5,662,183 to Fang, U.S. Patent Application Pubication No. 2008/0017421 A1 of Lockwood, U.S. Patent Application Publication No. 2007/0240910 A1 of Kembaiyan et al., and U.S. Patent Application Publication No. 2004/0245024 A1 of Kembaiyan.

A look at a few of these patents and published patent applications will help the reader to understand the state of the art. U.S. Patent Application Publication No. 2007/0240910 A1 discloses a composition for forming a matrix body which includes spherical sintered tungsten carbide and an infiltration binder including one or more metals or alloys. The composition may also include cast tungsten carbide and/or carburized tungsten carbide. The amount of sintered spherical tungsten carbide in the composition preferably is in the range of about 30 to about 90 weight percent. Spherical or crushed cast carbide, when used, may comprise 15 to 50 weight percent of the composition and the carburized tungsten carbide, when used, may comprise about 5 to 30 weight percent of the composition. The composition may also include about 1 to 12 weight percent of one or more metal powders selected from the group consisting of nickel, iron, cobalt, and other Group VIIIB metals and alloys thereof.

U.S. Pat. No. 7,475,743 B2 discloses a subterranean drill bit that includes a bit body formed from an infiltrated metal matrix powder wherein the matrix powder mixture includes stoichiometric tungsten carbide particles, cemented tungsten carbide particles, cast tungsten carbide particles, and a metal powder. The stoichiometric tungsten carbide particles may have a particle size of −325 (45 micron) +625 mesh (20 micron) and comprise up to 30 weight percent of the matrix powder. The cemented tungsten carbide particles may have a particle size of −170 (90 micron) +625 mesh (20 micron) and account for up to 40 weight percent of the matrix powder. The cast tungsten carbide may have a particle size of −60 (250 micron) +325 mesh (45 micron) and account for up to 60 weight percent of the matrix powder. The metal powder may account for between 1 and 15 weight percent of the matrix powder and may include one or more of nickel, iron, cobalt, and other Group VIIIB metals and alloys thereof.

U.S. Pat. No. 6,682,580 B2 discloses matrix powder mixtures which may be used for producing bodies or components for wear-resistant applications such as drill bits. The matrix powder mixtures contain spheroidal hard material particles having a particle size of less than 500 microns, and preferably in the range of between 20 to 250 microns. The spheroidal hard material particles comprise between about 5 and 100 weight percent of the matrix powder. The matrix powder may also include block hard materials in the size range of between 3 and 250 microns and in the form of crushed carbides or metal powder. These block hard materials function as spacers between the spherical hard material particles to aid in the infiltration of the matrix powder. The spherical hard particles may be spheroidal carbides and are preferably spheroidal cast tungsten carbide. They also may be dense sintered cemented tungsten powders with a closed porosity or pore-free sintered cemented tungsten carbide pellets. The spheroidal carbides also may be carbides of the metals in the group consisting of tungsten, chromium, molybdenum, vanadium, and titanium. The metal powder may comprise between about 1 to 12 weight percent of the matrix powder and be selected from the group consisting of cobalt, nickel, chromium, tungsten, copper, and alloys and mixtures thereof.

U.S. Pat. No. 5,733,664 also discloses matrix powder mixtures suitable to be infiltrated to form wear element bodies or components for wear-resistant applications such as drill bits. The matrix powder mixtures include crushed sintered cemented tungsten carbide particles, wherein a binder metal comprises between about 5 and 20 weight percent of the cemented tungsten carbide composition. The crushed sintered cemented tungsten carbide powder may account for 50 to 100 weight percent of the matrix powder and have a particle size of −80 (180 micron) +400 mesh (38 micron). The matrix powder mixture may also include up to 24 weight percent of cast tungsten carbide having a particle size of −270 mesh (53 micron) with superfines removed; up to 50 weight percent tungsten carbide particles having a particle size of −80 (180 micron) +325 mesh (45 micron); and between about 0.5 and 1.5 weight percent of iron having an average particle size of 3-5 microns.

Although these earlier infiltrated metal matrices have performed in a satisfactory fashion, there is still an unfilled need for subterranean drill bit bodies for particular applications which require infiltrated metal matrices having a combination of good erosion resistance, reasonable strength, and good thermal stability. The present invention addresses that unfilled need.

SUMMARY OF THE INVENTION

The present invention provides subterranean drill bits comprising at least one cutting element carried by a bit body having the desired combination of good erosion resistance, reasonable strength, and good thermal stability. The bit body comprises an infiltrated metal matrix which includes an infiltrant and a metal powder mixture. The metal powder mixture comprises about 30 to 90 weight percent of a first component powder, about 10 to 70 weight percent of a second component powder, and up to about 12 weight percent of a third component powder. The first component powder consists of particles of cast tungsten carbide of +140 mesh (106 micron) particle size. At least 15 weight percent of the matrix powder mixture consists of first component powder particles having a particle size of +100 mesh (150 microns) and the matrix powder mixture contains substantially no particles of the first component powder which are less than 140 mesh (106 micron) in particle size. The second component powder consists of particles of at least one selected from the group consisting of macrocrystalline tungsten carbide, carburized tungsten carbide, and cemented tungsten carbide. The third component powder consists of particles of a metal selected from the group of at least one selected from the group consisting of transition metals, main group metals, and alloys and combinations thereof.

The particle size distribution of second component powder is selected so that these particles fit in among the cast carbide particles in a manner so as to enhance the thermal stability, toughness, and strength of the drill bit body. Preferably, the particle size of the second component powder is less than 80 mesh (177 micron).

Accordingly, one aspect of the present invention relates to subterranean drill bits comprising at least one cutting element for engaging a formation being carried by such infiltrated metal matrix bit bodies.

Another aspect of the present invention relates to matrix powder mixtures for making such infiltrated metal matrix bit bodies.

BRIEF DESCRIPTION OF THE DRAWINGS

The criticality of the features and merits of the present invention will be better understood by reference to the attached drawings. It is to be understood, however, that the drawings are designed for the purpose of illustration only and not as definitions of the limits of the present invention.

DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims.

Inasmuch as an important aspect of the present invention is the particle size of the various powder components of the matrix powders which are used to form the subterranean drill bit bodies, it is necessary to have a means for describing those particle sizes. Mesh size is a convenient means for describing the particle sizes of a powder and is used herein for that purpose with regard to the description of the present invention. Mesh sizes are also sometimes called "sieve sizes" or "screen sizes." The numerical portion of the mesh size refers to the number of square openings there are per lineal inch (2.54 cm) of the mesh taken in a direction parallel to the sides of the square openings. For example, 100 mesh refers to a mesh having 100 openings per lineal inch (2.54 cm). Since the length of a side of an opening in the mesh depends on the thickness of the filaments that make up the mesh, various standards have been adopted to govern the filament thickness, and, thereby, side length of the openings. Mesh sizes based upon ASTM Standard E 11-70 (1995), i.e., U.S. mesh sizes, are used herein. To help the reader to better visual the mesh size, herein the nominal side length of the mesh opening is given parenthetically in microns following the mesh size value. Powder passing through a particular mesh size mesh is said to have that mesh size. For example, powder passing through a 100 mesh size mesh is said to be 100 mesh (150 micron) powder. This may also be expressed by placing a minus sign (−) before the mesh size number. For example, a −100 mesh (150 micron) powder will pass through a 100 mesh (150 micron) mesh. A plus (+) sign placed before the mesh size number is used to indicate that the powder is too coarse to pass through a mesh of that mesh size. For example, a +100 mesh (150 micron) powder does not pass through a 100 mesh (150 micron) mesh. Sometimes two mesh sizes given side by side are used to better describe the particle size of a powder. Under this convention, a minus sign (−) is placed before the first mesh size number (and the word "mesh" beside this number is omitted) to indicate that the powder is small enough to pass through a mesh having that mesh size, and a positive sign (+) is placed before the second mesh size to indicate that the powder is too coarse to pass through a mesh having that mesh size. Thus, a powder sample described as −100 (150 micron) +325 mesh (45 micron) is fine enough to pass through a 100 mesh screen and too coarse to pass through a 325 mesh (45 micron) mesh.

Subterranean Drill Bits

Figure 1:
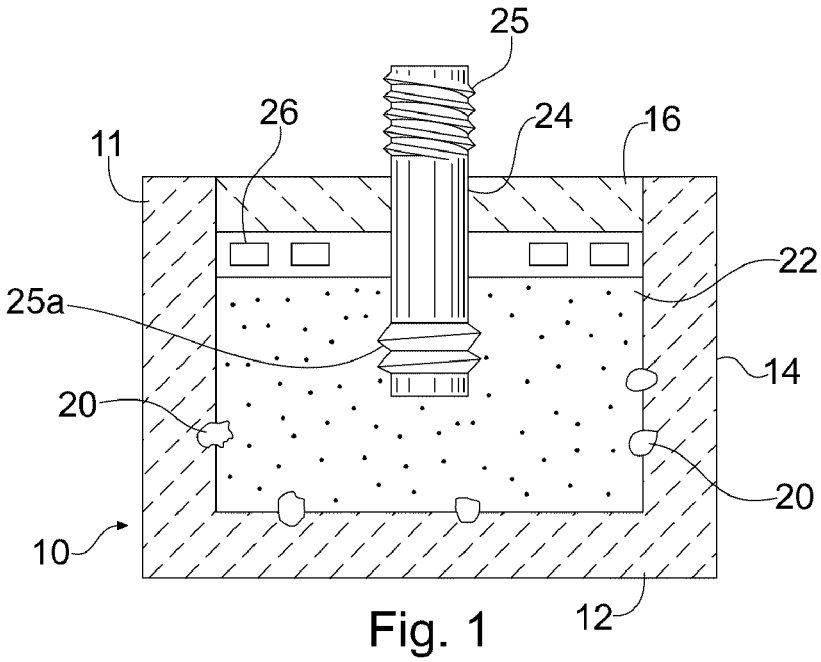
FIG. 1 is a schematic view of an assembly used to make a subterranean drill bit according to an embodiment of the present invention.

Referring to FIG. 1, there is illustrated a schematic of an assembly 10 used to manufacture a subterranean drill bit in accordance with an embodiment of the present invention. The drill bit has a shank 24. Cutter elements, such as discrete cutting elements 20, are bonded to the resultant drill bit by way of the metal matrix of the drill bit body. Although the method by which a drill bit shank is affixed to a drill line may vary, one common method is to provide threads on the shank so that the shank threadedly engages a threaded bore in the drill line. Another way is to weld the shank to the drill line.

The assembly 10 includes a graphite mold 11 having a bottom wall 12 and an upstanding wall 14. The mold 11 defines a volume therein. The assembly 10 further includes a top member 16 to close the opening of the mold 11. The use of the top member 16 is optional depending upon the degree of atmospheric control one desires to have over the contents of the mold 11 during thermal processing.

The steel shank 24 is positioned within the mold 11 before the matrix powder mixture 22 is poured therein. A portion of the steel shank 24 is within the matrix powder mixture 22 and another portion of the steel shank 24 is outside of the matrix powder mixture 22. The shank 24 has threads 25 at one end thereof, and grooves 25A at the other end thereof.

A plurality of discrete cutting elements 20 are positioned to extend into the bottom and upright mold walls 12, 14 so as to be at selected positions on the surface of the resultant drill bit. The matrix powder mixture 22 is poured into the mold 11 so as to surround the portions of the cutting elements 20 which extend into the cavity of the mold 11. It is to be understood that in addition to or instead of setting the cutting elements 20 into the walls of the mold 11, cutting elements 20 may be mixed in with the matrix powder mixture 22 in amounts up to about 20 volume percent. The composition of the matrix powder mixture 22 is discussed later herein.

After the cutting elements 20 have been set and the matrix powder mixture 22 has been poured into the mold 11, a solid infiltrant 26 is positioned above the matrix powder mixture 22. The top member 16 is then, optionally, positioned to close the opening of the mold 11. The assembly 10 is then placed into a furnace and heated to an elevated temperature so that the infiltrant 26 melts and infiltrates throughout the matrix powder mixture 22. The furnace atmosphere is selected to be compatible with the components of the assembly 10 and typically comprises one or more of nitrogen, hydrogen, argon, and air. The assembly 10 is then cooled to solidify the infiltrant 26. The solidified infiltrant 26 bonds together the matrix powder mixture 22, the cutting elements 20, and the steel shank 24 to form a subterranean drill bit.

Figure 2:
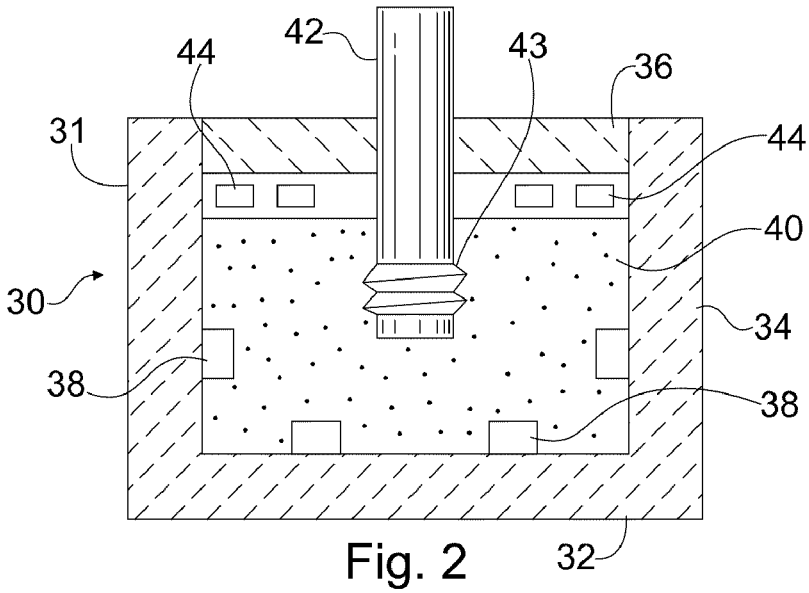
FIG. 2 is a schematic view of an assembly used to make a subterranean drill bit according to another embodiment of the present invention.

Referring to FIG. 2, there is illustrated a schematic of an assembly 30 used to manufacture a subterranean drill bit in accordance with another embodiment of the present invention. The assembly 30 includes a graphite mold 31 having a bottom wall 32 and an upstanding wall 34. The mold 31 defines a volume therein. The assembly 31 further includes a top member 36 to close off the opening of the mold 31. The use of the top member 36 is optional depending upon the degree of atmospheric control one desires to have over the contents of the mold 31 during thermal processing.

A steel shank 42 is positioned within the mold 31 before a matrix powder mixture 40 is poured therein. A portion of the steel shank 42 is within the matrix powder mixture 40 and another portion of the steel shank 42 is outside of the matrix powder mixture 40. The shank 42 has grooves 43 at the end that is within the matrix powder mixture 40.

A plurality of graphite blanks 38 are positioned along the bottom and upright mold walls 32, 34 so as to be at selected positions on the surface of the resultant drill bit. The matrix powder mixture 40 is poured into the mold 31 so as to surround the portions of the graphite blanks 38 which extend into the cavity of the mold 31. The composition of the matrix powder mixture 40 is discussed later herein.

After the graphite blanks 38 have been set and the matrix powder mixture 40 has been poured into the mold 31, a solid infiltrant 44 is positioned above the matrix powder mixture 40. The top member 36 is then, optionally, positioned to close the opening of the mold 31. The assembly 30 is then placed into a furnace and heated to an elevated temperature so that the infiltrant 44 melts and infiltrates throughout the matrix powder mixture 40. The furnace atmosphere is selected to be compatible with the components of the assembly 30 and typically comprises one or more of nitrogen, hydrogen, argon, and air. The assembly 30 is then cooled to solidify the infiltrant 44. The solidified infiltrant 44 bonds together the matrix powder mixture 40, the graphite blanks 38, and the steel shank 42. The graphite blanks 38 are removed from the bonded mass. Cutting elements, such as diamond composite inserts, are brazed into the recesses left by the removal of the graphite blanks 38 to form a subterranean drill bit.

Figure 3A:
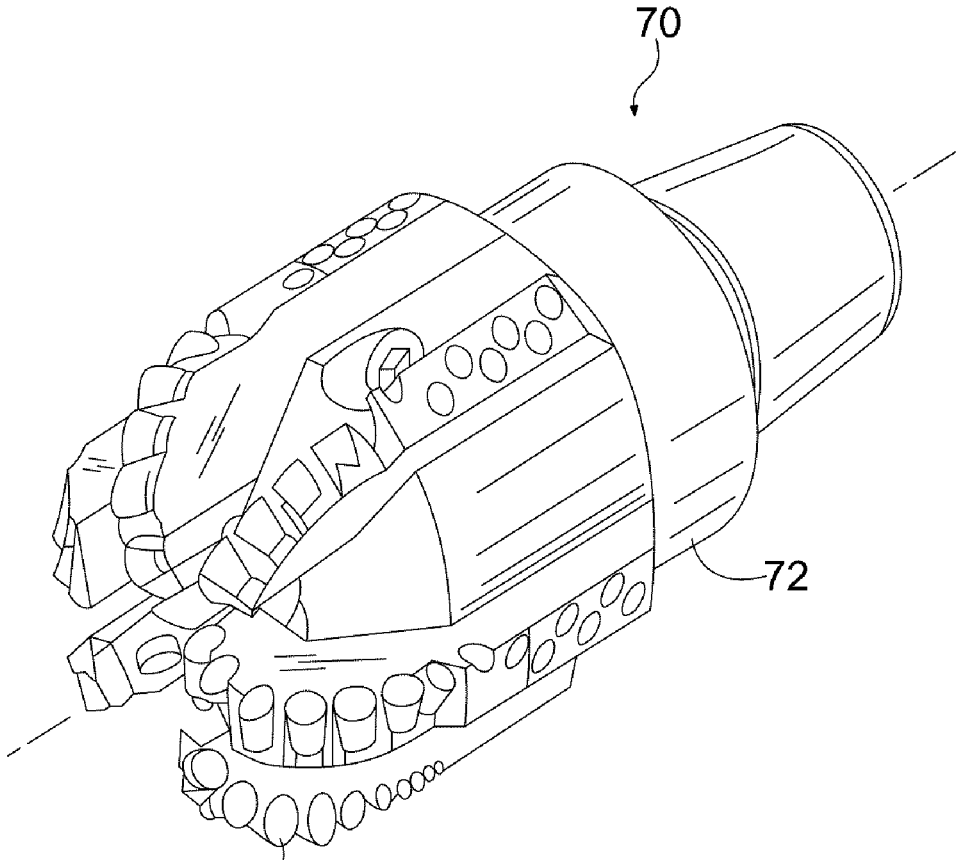
FIG. 3A is an isometric view of a subterranean drill bit according to another embodiment of the present invention.
Figure 3:
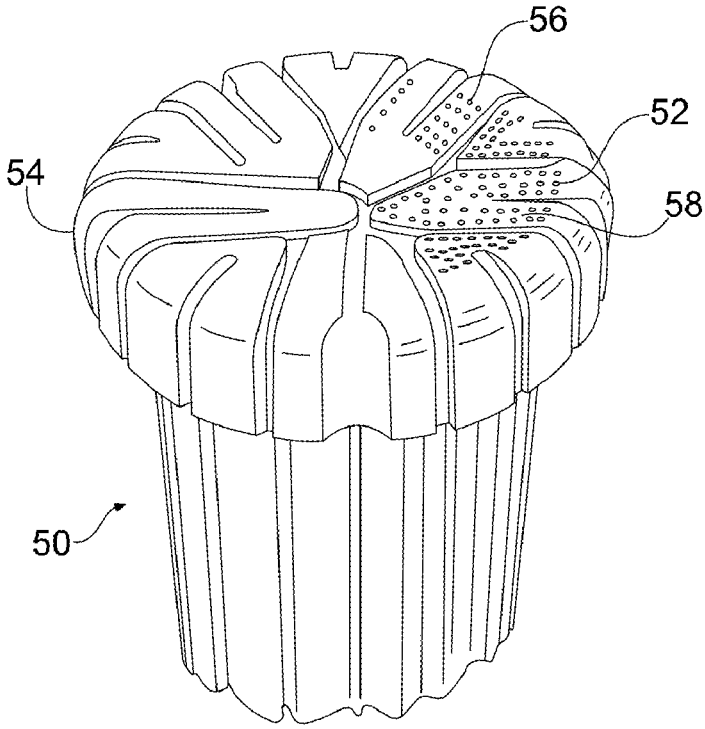
FIG. 3 is an isometric view of a subterranean drill bit according to an embodiment of the present invention.

Referring to FIG. 3, there is shown a subterranean drill bit 50 according to an embodiment of the present invention. The drill bit 50 may be made from a process similar to that described above with regard to FIG. 1. The forward facing surface 52 of the bit body 54 of the drill bit 50 contains cutting elements 56 extending from the infiltrated metal matrix 58 which resulted from the freezing of an infiltrant throughout a matrix powder mixture.

Referring to FIG. 3A, there is shown a subterranean drill bit 70 according to another embodiment of the present invention. The drill bit 70 has a bit body 72 and cutting elements 74. The bit body 72 comprises an infiltrated metal matrix. The cutting elements 74 are brazed to the bit body 72.

It is to be understood that the subterranean drill bits according to the present invention are not limited to the geometric designs described in the foregoing embodiments. Rather, they include all subterranean drill bits having at least one cutting element carried by a bit body in which the bit body comprises an infiltrated metal matrix comprising an infiltrant and a matrix powder mixture, in which the matrix powder mixture comprises (a) about 30 to about 90 weight percent of a first component powder consisting of particles of cast tungsten carbide of −30 (600 micron) +140 (106 micron) in particle size; (b) about 10 to about 70 weight percent of a second component powder consisting of particles of at least one selected from the group consisting of macrocrystalline tungsten carbide, carburized tungsten carbide, and cemented tungsten carbide; and (c) up to about 12 weight percent of a third component powder consisting of particles of at least one selected from the group consisting of transition metals, main group metals, and alloys and combinations thereof, wherein the matrix powder mixture contains substantially no particles of the first component powder of −140 mesh (106 micron) in particle size and particles of the first component powder having a particle size of +100 mesh (150 microns) account for at least 15 weight percent of the matrix powder mixture.

Cutting Element

Each subterranean drill bit according to the present invention has one or more cutting elements. The cutting elements are preferably natural diamond, polycrystalline diamond sintered to cemented carbide, thermally stable polycrystalline diamond, or a hot pressed metal matrix composite, but can be any suitable hard material known in the art. The size and configuration of each the cutting element is selected to be appropriate for the purpose and the conditions under which it is to be used.

The manner in which the bit body carries an individual cutting element depends on the design of the particular drill bit and the design of the particular cutting element For example, cutting elements may be carried directly by the bit body, e.g., by imbedding the cutting elements in the infiltrated metal matrix of the bit body or brazing them to the bit body. Alternatively, the cutting elements may be carried indirectly by the bit body, e.g., by affixing the cutting elements to blades which themselves are affixed to the bit body. For example, U.S. Patent Application Publication No. 2008/0289880 A1 of Majagi et al., which is assigned to the assignee of the present patent application, describes a bit body carrying cutting elements which are affixed to blades, which are, in turn, affixed to the bit body.

Any technique or method known in the art may be used for affixing individual cutting elements and/or blades having cutting elements to the drill bit body, including brazing techniques, infiltration techniques, press fitting techniques, shrink fitting techniques, and welding techniques.

Infiltrated Metal Matrix

The infiltrated metal matrixes of embodiments of the present invention comprise (i) an infiltrant, and (ii) a matrix powder mixture.

(i) Infiltrants

All infiltrants known in the art of making infiltrated metal matrix powder subterranean drill bits and similar wear resistant elements may be used in embodiments of the present invention. Examples of infiltrants include metals and alloys comprising one or more transition metal element and main group element. Copper, nickel, iron, and cobalt may be used as the major constituent of the infiltrant and elements such as aluminum, manganese, chromium, zinc, tin, silicon, silver, boron, and lead may be minor constituents.

Preferred infiltrants are copper-based alloys containing nickel and manganese, and optionally tin and or lead. Particularly preferred infiltrants of this type are those which are disclosed in U.S. Patent Application Publication No. 2008/0206585 A1 of Deng et al. Another particularly preferred infiltrant is the alloy that is available under the trade name MACROFIL 53 from the assignee of this application, Kennametal Inc. of Latrobe, Pa. 15650 US and under the trade name VIRGIN binder 453 D from Belmont Metals Inc, 330 Belmont Avenue, Brooklyn, N.Y. 11207 US. This infiltrant has a nominal composition (in weight percent) of 53.0 percent copper, 24.0 percent manganese, 15.0 percent nickel, and 8.0 percent zinc. Another particularly preferred infiltrant is available under the trade name MACROFIL 65 from the assignee of this application. This infiltrant has a nominal composition (in weight percent) of 65 percent copper, 15 percent nickel, and 20 percent zinc. Another preferred infiltrant has a nominal composition (in weight percent) of less than 0.2 percent silicon, less than 0.2 percent boron, up to 35 percent nickel, 5-35 percent manganese, up to 15 percent zinc, and the balance copper.

For any particular embodiment of the present invention, the type and amount of the infiltrant is selected so that it is compatible with the other components of the subterranean drill bit with which it is to be in operational contact. It is also selected so as to provide the drill bit with the desired levels of strength, toughness, and durability. The amount of infiltrant is selected so that there is sufficient infiltrant to completely infiltrate the matrix powder mixture. Typically, the infiltrant makes up between about 20 and 40 volume percent of the infiltrated metal matrix.

(ii) Matrix Powder Mixtures

The matrix powder mixtures of the embodiments of the present invention comprise (a) about 30 to 90 weight percent of a first component powder, (b) about 10 to 70 weight percent of a second component powder, and (c) up to about 12 weight percent of a third component powder. The matrix powder mixtures are made by blending the component powders together to form a homogeneous mixture.

(ii)(a) First Component Powder

The first component powder consists of cast tungsten carbide powder which has a particle size of no smaller than 140 mesh (106 micron). The cast tungsten carbide provides the resultant drill bit with good erosion resistance. Cast tungsten carbide consists of an approximately eutectoid composition of tungsten and carbon having a rapidly solidified thermodynamically nonequilibrium microstructure consisting of an intimate mixture of tungsten carbide (WC) and ditungsten carbide ($W_2C$). The carbon content of cast tungsten carbide is typically in the range of between about 3.7 to 4.2 weight percent.

Cast tungsten carbide powder is available in two forms, crushed and spherical. Although either form may be used with the present invention, the crushed form is preferred because it costs significantly less and is much less brittle than the spherical form.

The particle sizes of the cast tungsten carbide powder used in the matrix powder mixtures of embodiments of the present invention are −30 (600 micron) +140 mesh (106 micron) with substantially no cast tungsten carbide powder of less than 140 mesh (106 micron) and with at least 15 weight percent of the matrix powder mixture weight consisting of +100 mesh (150 micron) cast tungsten carbide powder. The phrase "substantially no cast carbide smaller than X mesh" is to be construed to mean that no more than about 10 weight percent of the cast tungsten carbide powder is to be smaller than the indicated mesh size. Thus, in accordance with the present invention, no more than 10 weight percent of the cast tungsten carbide powder present in the matrix powder mixture is smaller than −140 mesh (106 micron) mesh.

The present invention eliminates substantially all fine cast tungsten carbide particles from the matrix powder mixture, because cast tungsten carbide particles of this size are less thermally stable than are similar size particles of other forms of tungsten carbide, due to the nonequilibrium microstructure of the cast tungsten carbide. The present invention also limits the maximum particle size of cast tungsten carbide particles so as to avoid compromising the strength and toughness of the infiltrated metal matrix. Accordingly, the particle size of the cast tungsten carbide powder preferably is −30 (600 micron) +140 mesh (106 micron), and more preferably is −40 (425 micron) +140 mesh (106 micron), and most preferably is −60 (250 micron) +140 mesh (106 micron).

The amount of the first component powder in the matrix powder mixture ranges from about 30 to about 90 weight percent. The higher amounts result in more erosion resistance and the lower amounts in more strength and toughness for the resultant infiltrated metal matrix. Preferably, the amount of the first component powder in the matrix powder mixture is at least about 50 weight percent, and is more preferably at least about 60 weight percent.

(ii)(b) Second Component Powder

The second component powder of the matrix powder mixture of embodiments of the present invention consists of particles selected from at least one of the group consisting macrocrystalline tungsten carbide, carburized tungsten carbide, and cemented tungsten carbide. The role of the second component powder is to enhance the thermal stability, strength, and toughness of the resultant infiltrated metal matrix.

Macrocrystalline tungsten carbide is essentially stoichiometric tungsten carbide (WC) which is, for the most part, in the form of single crystals. Some large crystals of macrocrystalline tungsten carbide are bicrystals. U.S. Pat. No. 3,379,503 to McKenna and U.S. Pat. No. 4,834,963 to Terry et al., both of which are assigned to the assignee of the present patent application, disclose methods of making macrocrystalline tungsten carbide.

Carburized tungsten carbide is a type of tungsten carbide that is made by solid state diffusing carbon into tungsten particles at high temperatures in a protective atmosphere.

Cemented tungsten carbide powder is also sometimes known as sintered cemented tungsten carbide. Cemented tungsten carbide consists of tungsten carbide particles bonded together by a binder phase comprising at least one of cobalt and nickel. Cemented tungsten carbide powder is available in two forms, crushed and pelletized (also known as spherical), either or both of which are suitable for use in the second component powder of the matrix powder mixture.

The particle size of the second component powder is selected so that the second component powder particles fit in among the first component powder particles in a manner so as to enhance the thermal stability, toughness, and strength of the resultant infiltrated metal matrix. Some preferred particle sizes of the second component powder are (a) −170 mesh (90 micron), (b) −230 mesh (63 micron), and (c) −325 mesh (45 micron). In some preferred embodiments, the second component powder contains substantially no particles −625 mesh (20 micron) in particle size.

The amount of the second component powder in the matrix mixture ranges from about 10 to about 70 weight percent. The higher amounts result in more toughness and strength and the lower amounts in more erosion resistance in the resultant infiltrated metal matrix. Preferably, the relative amounts of the first and second component powders are selected so that the ratio of the weight of the first component powder to that of the second component powder is in the range of from about 30:70 to about 85:15.

(ii)(c) Third Component Powder

The third component powder of the matrix powder mixture is a metal powder. The metal powder consists of at least one selected from the group consisting of the transition metals, main group metals, and combinations and alloys thereof. The metal powder is selected to aid in the infiltration of the matrix powder mixture by the infiltrant. Examples of preferred metal powders are nickel, iron, and 4600 grade steel. The 4600 grade steel has a nominal composition (in weight percent) of 1.57 percent nickel, 0.38 percent manganese, 0.32 percent silicon, 0.29 percent molybdenum, 0.06 percent carbon, and the balance iron.

The particle size of the third component powder is selected so that it blends well into the metal powder mixture. Preferably, the particle size of the third component is −230 mesh (63 micron).

The amount of the third component in the matrix powder mixture is in the range of about 0 to about 12 weight percent. Preferably, the amount of the third component powder is in the range of about 1 to about 4 weight percent.

EXAMPLES

Examples 1-7

For each example, a matrix powder mixture in accordance with an embodiment of the present invention was prepared by blending together into a uniform mixture the component powders listed in Table 1. These examples are identified in Tables 1 and 3 by the designations Ex. 1 through Ex. 7. The first component powder ("component powder 1") consisted of crushed cast tungsten carbide. The second component powder ("component powder 2") consisted of macrocrystalline tungsten carbide. The type of the third component powder ("component powder 3") used in each example is given in Table 1. For each example, the matrix powder mixture was placed into a graphite mold and subsequently infiltrated with MACROFIL 53 to create an infiltrated metal matrix.

Figure 4:
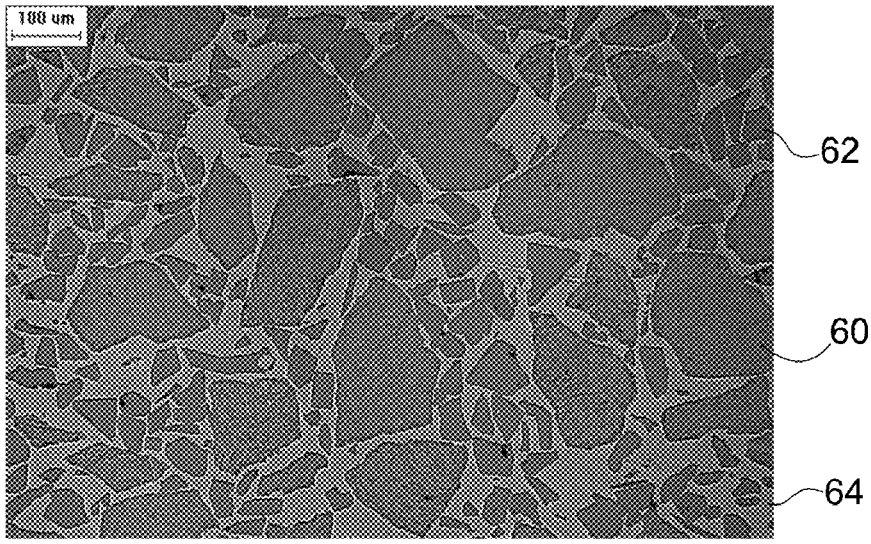
FIG. 4 is a photomicrograph of the microstructure of an infiltrated metal matrix according to an embodiment of the present invention.

A photomicrograph of the microstructure of the Example 1 infiltrated metal matrix appears in FIG. 4. The two phase microstructure of the crushed cast tungsten carbide particles of component powder 1, e.g., particle 60, distinguish those particles from the macrocrystalline tungsten carbide particles of component powder 2, e.g., particle 62, which have a single phase microstructure. The binding material 64 that surrounds the crushed cast tungsten carbide particles and the macrocrystalline tungsten carbide particles consists of the MACROFIL 53 infiltrant in combination with the nickel powder of the third component powder.

TABLE 1

Examples of Matrix Powder Mixtures of the Present Invention

| Example | Component Powder 1 | | Component Powder 2 | | Component Powder 3 | |
|---|---|---|---|---|---|---|
| ID | wt. % | mesh size | wt. % | mesh size | wt % | type |
| Ex. 1 | 23 | −60 + 80 | 25 | −80 + 325 | 4 | nickel |
| | 23 | −80 + 120 | 25 | −325 | | |
| Ex. 2 | 38 | −60 + 80 | 20 | −325 | 4 | nickel |
| | 38 | −80 + 140 | | | | |
| Ex. 3 | 10 | −60 + 80 | 43 | −120 + 325 | 2 | nickel |
| | 20 | −80 + 120 | 25 | −325 | | |
| Ex. 4 | 20 | −60 + 80 | 25 | −120 + 325 | 2 | nickel |
| | 28 | −80 + 120 | 25 | −325 | | |
| Ex. 5 | 23 | −60 + 80 | 25 | −120 + 325 | 2 | nickel |
| | 25 | −80 + 120 | 25 | −325 | | |
| Ex. 6 | 30 | −60 + 80 | 23 | −325 | 2 | nickel |
| | 45 | −80 + 140 | | | | |
| Ex. 7 | 30 | −60 + 80 | 15 | −230 + 325 | 2 | nickel |
| | 45 | −80 + 140 | 8 | −325 | | |

Comparative Samples 1-4

For each comparative sample, a matrix powder mixture was prepared by blending together into a uniform mixture the components listed in Table 2. The comparative samples are identified in Tables 2 and 3 by the designations Comp. 1 through Comp. 4. The first component powder ("component powder 1") consisted of crushed cast tungsten carbide. The second component powder ("component powder 2") consisted of macrocrystalline tungsten carbide. The type of the third component powder ("component powder 3") used in each example is given in Table 2. For each comparative sample, the matrix powder mixture was placed into a graphite mold and subsequently infiltrated with MACROFIL 53 to create an infiltrated metal matrix.

TABLE 2

Comparative Sample Matrix Powder Mixtures

| Comparative | Component Powder 1 | | Component Powder 2 | | Component Powder 3 | |
|---|---|---|---|---|---|---|
| Sample ID | wt. % | mesh size | wt. % | mesh size | wt % | type |
| Comp. 1 | 31 | −325 | 67 | −80 + 325 | 1 | iron |
| | | | | | 1 | 4600 |
| Comp. 2 | 15 | −325 | 83 | −80 + 325 | 2 | nickel |
| Comp. 3 | 20 | −80 + 325 | 41 | −80 + 325 | 4 | nickel |
| | 10 | −325 | 25 | −325 | | |
| Comp. 4 | 20 | −60 + 80 | 54 | −80 + 325 | 1 | Fe |
| | 24 | −325 | | | 1 | 4600 |

Properties

Appropriate size specimens of each of the Example 1-7 infiltrated metal matrices materials and of each of the Comparative Samples 1-4 infiltrated metal matrices were used for measuring the hardness, transverse rupture strength, toughness, abrasion [,] resistance, and erosion resistance. The results of the measurements are summarized in Table 3.

The hardness was measured on the Rockwell C hardness scale in accordance with ASTM Standard B347-85. Higher values mean indicate greater hardness. The transverse rupture strength was measured by a three-point bending test using infiltrated matrix pins of 0.5 inch (1.27 cm) diameter and 3 inch (7.62 cm) length. Higher values indicate higher strength.

The toughness was measured using an impacting test modified after ASTM E23. Higher values indicate greater toughness. The wear resistance was measured in accordance with ASTM Standard B611. Higher values indicate better wear resistance. The abrasion resistance was measured in accordance with ASTM Standard G65. Lower values indicate better resistance to abrasion wear. The erosion resistance was measured in accordance with ASTM Standard G76. A lower erosion factor value indicates better resistance to erosion.

Figure 5:
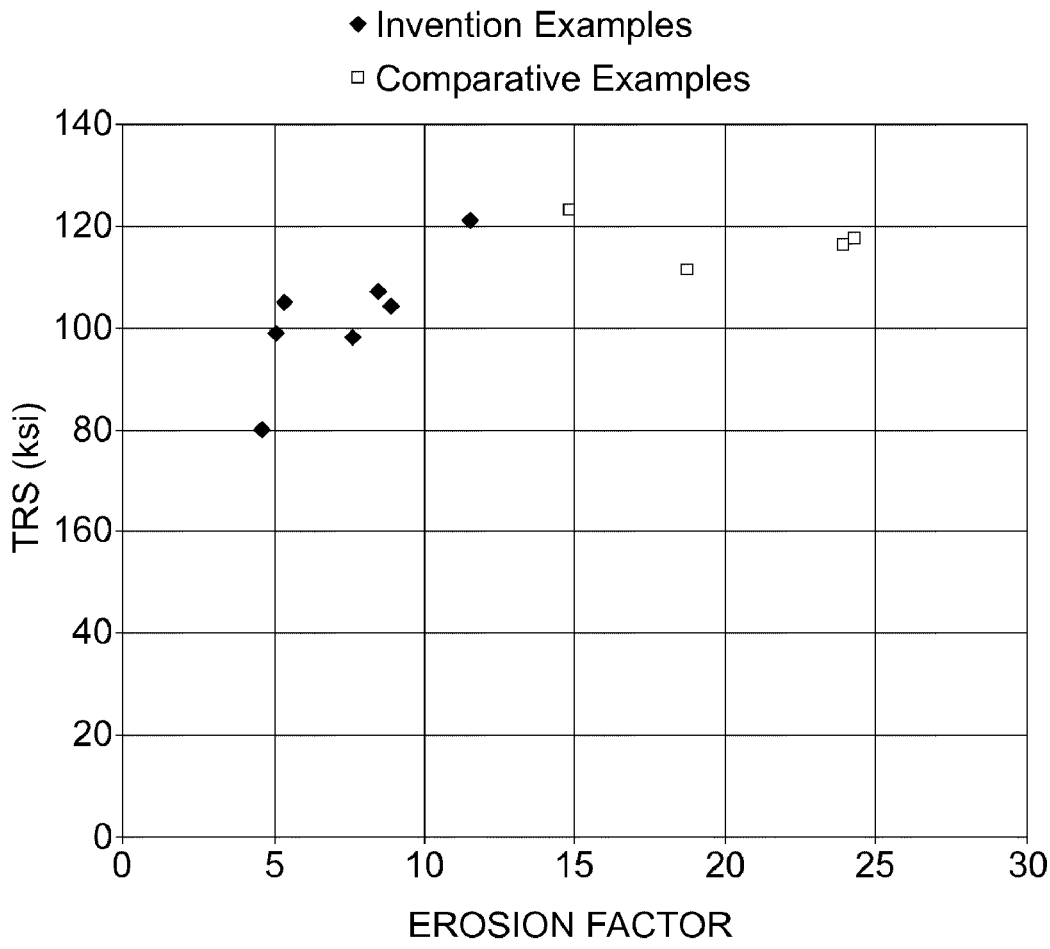
FIG. 5, which shows a plot of the transverse rupture strength versus the erosion resistance data from Table 3, wherein the results of the examples of the present invention are indicated by diamond markers while those of the comparative samples are indicated by square markers.

The test results show that examples of the infiltrated metal matrixes of the present invention are generally harder and are more resistant to wear, abrasion, and erosion than are those of the comparative samples while having comparable levels of strength and impact resistance. This is also illustrated in FIG. 5, which shows a plot of the transverse rupture strength versus the erosion resistance data from Table 3, wherein the results of the examples of the present invention are indicated by diamond markers while those of the comparative samples are indicated by square markers.

TABLE 3

| | Properties | | | | | | | |
|---|---|---|---|---|---|---|---|---|
| | Hardness | Transverse Rupture Strength | | Toughness | | Wear Resistance | Abrasion Resistance | Erosion Resistance (erosion |
| ID | (Rockwell C) | (ksi) | (MPa) | (ft-lbs) | (joules) | (krev/cm$^3$) | (mm$^3$) | factor value) |
| Ex. 1 | 52 | 98 | 676 | 1.5 | 2.0 | 1.4 | 5.3 | 7.65 |
| Ex. 2 | 52 | 80 | 552 | 1.5 | 2.0 | 1.4 | 8.8 | 4.62 |
| Ex. 3 | 40 | 121 | 834 | 2.6 | 3.5 | 0.8 | 8.3 | 11.6 |
| Ex. 4 | 40 | 107 | 738 | 2.3 | 3.1 | 1.4 | 5.3 | 8.5 |
| Ex. 5 | 41 | 104 | 717 | 2.5 | 3.4 | 0.9 | 5.0 | 8.9 |
| Ex. 6 | 40 | 99 | 683 | 2.0 | 2.7 | 0.93 | 10.1 | 5.1 |
| Ex. 7 | 41 | 105 | 724 | 2.2 | 3.0 | 1.0 | 10.1 | 5.4 |
| Comp. 1 | 33 | 116 | 800 | 2.6 | 3.5 | 0.65 | 15 | 24.0 |
| Comp. 2 | 38 | 117 | 807 | 2.4 | 3.3 | 0.81 | 10 | 24.34 |
| Comp. 3 | 48 | 123 | 848 | 2.8 | 3.8 | 1.0 | 6.3 | 14.87 |
| Comp. 4 | 30 | 111 | 765 | 2.5 | 3.4 | 0.78 | 7.3 | 18.78 |

While only a few embodiments of the present invention have been shown and described, it will be obvious to those skilled in the art that many changes and modifications may be made thereunto without departing from the spirit and scope of the present invention as described in the following claims. All patent applications, patents, and all other publications referenced herein are incorporated herein in their entireties to the full extent permitted by law.

What is claimed is:

1. A subterranean drill bit comprising:

(a) at least one cutting element, and (b) a bit body having an infiltrated metal matrix, wherein the infiltrated metal matrix comprises:

(i) an infiltrant, and (ii) a matrix powder mixture comprising:

(A) about 30 to about 90 weight percent of a first component powder, the first component powder consisting of particles of cast tungsten carbide of −30 (600 micron) +140 (106 micron) in particle size;

(B) about 10 to about 70 weight percent of a second component powder, the second component powder consisting of particles of at least one selected from the group consisting of macrocrystalline tungsten carbide, carburized tungsten carbide, and cemented tungsten carbide; and (C) up to about 12 weight percent of a third component powder, the third component powder consisting of particles of at least one selected from the group consisting of transition metals, main group metals, and alloys and combinations thereof;

wherein the bit body carries the cutting element and the matrix powder mixture contains substantially no particles of the first component powder of −140 mesh (106 micron) in particle size and particles of the first component powder having a particle size of +100 mesh (150 microns) account for at least 15 weight percent of the matrix powder mixture.

2. The subterranean drill bit of claim 1, wherein the cutting element comprises at least one selected from the group consisting of polycrystalline diamond, natural diamond, and thermally stable polycrystalline diamond.

3. The subterranean drill bit of claim 1, wherein the first component powder has a particle size range selected from the group consisting of −40 (425 micron)+140 mesh (106 micron) and −60 (250 micron) +140 mesh (106 micron).

4. The subterranean drill bit of claim 1, wherein the second component powder particle size is selected from the group consisting of −80 mesh (180 micron), −170 mesh (90 micron), and −325 mesh (45 micron).

5. The subterranean drill bit of claim 1, wherein the weight ratio of the first component powder to that of the second component powder is in the range of from about 30:70 to about 85:15.

6. The subterranean drill bit of claim 1, wherein the matrix powder mixture contains substantially no particles of the second component powder of −625 mesh (20 micron) in particle size.

7. The subterranean drill bit of claim 1, wherein the third component powder includes at least one selected from the group consisting of nickel, iron, copper, steel, and alloys and combinations thereof.

8. The subterranean drill bit of claim 1, wherein the matrix powder mixture comprises about 50 to about 90 weight of the first component powder, about 9 to about weight percent of the second component powder, and up to about 10 weight percent of the third component powder .

9. The subterranean drill bit of claim 1, wherein the matrix powder mixture comprises about 60 to about 90 weight percent of the first component powder and about 9 to about 40 weight percent of the second component powder.

10. A matrix powder mixture comprising:

a) about 30 to about 90 weight percent of a first component powder, the first component powder consisting of particles of cast tungsten carbide of −30 (600 micron) +140 (106 micron) in particle size;

b) about 10 to about 70 weight percent of a second component powder, the second component powder consisting of particles of at least one selected from the group consisting of macrocrystalline tungsten carbide, carburized tungsten carbide, and cemented tungsten carbide; and c) up to about 12 weight percent of a third component powder, the third component powder consisting of particles of at least one selected from the group consisting of transition metals, main group metals, and alloys and combinations thereof;

wherein the matrix powder mixture contains substantially no particles of the first component powder of −140 mesh (106 micron) in particle size and particles of the first component powder having a particle size of +100 mesh (150 microns) account for at least 15 weight percent of the matrix powder mixture.

11. The matrix powder mixture of claim 10, wherein the first component powder has a particle size range selected from the group consisting of −40 (425 micron)+140 mesh (106 micron) and −60 (250 micron) +140 mesh (106 micron).

12. The matrix powder mixture of claim 10, wherein the second component powder particle size is selected from the group consisting of −80 mesh (180 micron), −170 mesh (90 micron), and −325 mesh (45 micron).

13. The matrix powder mixture of claim 10, wherein the weight ratio of the first component powder to that of the second component powder is in the range of from about 30:70 to about 85:15.

14. The matrix powder mixture of claim 10, wherein the matrix powder mixture contains substantially no particles of the second component powder of −625 mesh (20 micron) in particle size.

15. The matrix powder mixture of claim 10, wherein the third component powder includes at least one selected from the group consisting of nickel, iron, copper, steel, and alloys and combinations thereof.

16. The matrix powder mixture of claim 10, wherein the matrix powder mixture comprises about 50 to about 90 weight of the first component powder, about 9 to about 50 weight percent of the second component powder, and up to about 10 weight percent of the third component powder .

17. The matrix powder mixture of claim 10, wherein the matrix powder mixture comprises about 60 to about 90 weight percent of the first component powder and about 9 to about 40 weight percent of the second component powder.

18. A method of making a subterranean drill bit comprising the steps of:

a) providing a matrix powder mixture comprising:

(A) about 30 to about 90 weight percent of a first component powder, the first component powder consisting of particles of cast tungsten carbide of −30 (600 micron) +140 (106 micron) in particle size;

(B) about 10 to about 70 weight percent of a second component powder, the second component powder consisting of particles of at least one selected from the group consisting of macrocrystalline tungsten carbide, carburized tungsten carbide, and cemented tungsten carbide; and (C) up to about 12 weight percent of a third component powder, the third component powder consisting of particles of at least one selected from the group consisting of transition metals, main group metals, and alloys and combinations thereof;

wherein the matrix powder mixture contains substantially no particles of the first component powder of −140 mesh (106 micron) in particle size and particles of the first component powder having a particle size of +100 mesh (150 microns) account for at least 15 weight percent of the matrix powder mixture;

c) confining the matrix powder mixture within a graphite mold;

d) infiltrating an infiltrant into the confined matrix powder mixture to form a bit body;

e) fixing at least one cutting element to the bit body.

19. The method of claim 18, wherein step (e) includes attaching the cutting element to a wall of the graphite mold prior to step (b).

20. The method of claim 18, wherein step (e) includes attaching the cutting element to the bit body after step (d).

* * * * *

UNITED STATES PATENT AND TRADEMARK OFFICE

CERTIFICATE OF CORRECTION

PATENT NO. : 8,016,057 B2
APPLICATION NO. : 12/488162
DATED : September 13, 2011
INVENTOR(S) : Xin Deng and Jonathan W. Bitler It is certified that error appears in the above-identified patent and that said Letters Patent is hereby corrected as shown below:

In the drawings, Sheet 4, Fig. 5, on the vertical axis, the label "160" should read --60--.

In Column 6, Line 31, "thereof," should read --thereof;--.

In Column 12, Line 57, Claim 8, "90 weight" should read --90 weight percent--.

In Column 12, Line 58, Claim 8, "about weight percent" should read --about 50 weight percent--.

In Column 13, Line 42, Claim 16, "weight" should read --weight percent--.

Signed and Sealed this
Eighteenth Day of October, 2011

David J. Kappos

David J. Kappos
*Director of the United States Patent and Trademark Office*